US012332036B2

(12) United States Patent
Dara

(10) Patent No.: US 12,332,036 B2
(45) Date of Patent: Jun. 17, 2025

(54) AUTOMATIC RETENTION FIREARM MAGAZINE CARRIER

(71) Applicant: Jonathan Rolf Dara, Wendell, NC (US)

(72) Inventor: Jonathan Rolf Dara, Wendell, NC (US)

( * ) Notice: Subject to any disclaimer, the term of this patent is extended or adjusted under 35 U.S.C. 154(b) by 233 days.

(21) Appl. No.: 18/329,187

(22) Filed: Jun. 5, 2023

(65) Prior Publication Data

US 2023/0392912 A1 Dec. 7, 2023

Related U.S. Application Data

(63) Continuation-in-part of application No. 29/843,081, filed on Jun. 17, 2022.

(60) Provisional application No. 63/348,785, filed on Jun. 3, 2022.

(51) Int. Cl.
*F42B 39/02* (2006.01)

(52) U.S. Cl.
CPC ..... *F42B 39/02* (2013.01)

(58) Field of Classification Search
CPC ..... F42B 39/02; F42B 39/26; Y10S 224/931
USPC ..... 224/931; 206/3
See application file for complete search history.

(56) References Cited

U.S. PATENT DOCUMENTS

| | | | | |
|---|---|---|---|---|
| 7,780,048 | B2 * | 8/2010 | Howell | F42B 39/02 224/931 |
| 10,197,370 | B2 * | 2/2019 | Zhang | F42B 39/02 |
| 10,306,973 | B2 * | 6/2019 | Evans | F42B 39/02 |
| 10,537,167 | B2 * | 1/2020 | Bryant | F42B 39/02 |
| 10,716,376 | B2 * | 7/2020 | Buechin | A45C 11/00 |
| 11,986,083 | B2 * | 5/2024 | Stutz | A44B 99/00 |
| 12,247,815 | B2 * | 3/2025 | Smith | F42B 39/02 |

* cited by examiner

*Primary Examiner* — Adam J Waggenspack

(57) ABSTRACT

An automatic retention firearm magazine includes a mounting plate, a face plate, and a web. The mounting plate and the face plate are arranged opposite to each other. Each of the first side and second side of the mounting plate comprises a plurality of mounting plate attachment points. Each of the first side and second side of the face plate comprises a plurality of face plate attachment points. The web comprises a plurality of mounting plate complementary attachment points and a plurality of face plate complementary attachment points corresponding to the plurality of mounting plate attachment points and the plurality of face plate attachment points, respectively. The web is resilient to provide a retention force to keep the mounting plate and face plate in position.

19 Claims, 16 Drawing Sheets

AUTOMATIC RETENTION FIREARM MAGAZINE CARRIER

FIELD OF THE INVENTION

The present invention relates generally to an automatic retention firearm magazine carrier. More specifically, the present invention is a device that can fit a variety of magazines ranging in size and automatically conform to the magazine's profile.

BACKGROUND OF THE INVENTION

A firearm magazine is used for ammunition storage and feeding into a firearm body. Firearm magazines are built fixed into the firearm body or designed to be detachable from the firearm body. Many of the detachable firearm magazines are designed in various shapes and sizes depending on the type of firearm the firearm magazine is attached to. Due to the varying shapes and sizes of firearm magazines, some firearm magazine carriers have been designed to accommodate firearm magazines of various shapes and sizes. Many of these firearm magazine carriers are built with a bungee cord or other elastic type band to conform around the firearm magazine. This design allows various firearm magazines to be accommodated. However, if one of these elastic bands breaks at one spot, then the entire system cannot properly conform around the firearm magazine rendering the device useless, even if damaged.

Therefore, it is an objective of the present invention to provide users with an automatic retention firearm magazine carrier, that conforms to any size or shape firearm magazine.

SUMMARY OF THE INVENTION

The present invention intends to provide users with a device that automatically conforms to the profile of a firearm magazine and contains it within the carrier. In order to accomplish that, a preferred embodiment of the present invention comprises a mounting plate, a face plate, and a web. The mounting plate and the face plate are arranged opposite to each other. The mounting plate comprises a first end, a second end, a first side, and a second side. The face plate comprises a first end, a second end, a first side, and a second side. Each of the first side and second side of the mounting plate comprises a plurality of mounting plate attachment points. Each of the first side and second side of the face plate comprises a plurality of face plate attachment points. The web comprises a plurality of mounting plate complementary attachment points corresponding to the plurality of mounting plate attachment points such that the plurality of mounting plate attachment points is attachable to the plurality of mounting plate complementary attachment points of the web. The web further comprises a plurality of face plate complementary attachment points corresponding to the plurality of face plate attachment points such that the plurality of face plate attachment points is attachable to the plurality of mounting plate complementary attachment points of the web. The web is resilient to provide a retention force to keep the mounting plate and face plate in position.

In one embodiment, the present invention further comprises a depth adjustment plate attached to the mounting plate. The depth adjustment plate comprises a pair of depth adjustment plate mounting tabs, and the mounting plate further comprises a pair of elongated holes adjacent to the second end of the mounting plate. Each of the depth adjustment plate mounting tabs comprises a depth adjustment plate mounting hole and is provided with a nut and a screw such that a position of the depth adjustment plate is adjustable along the pair of elongated holes.

In one embodiment, the present invention further comprises a pair of magazine side guides located between the mounting plate and the face plate. One of the pair of magazine side guides is located adjacent to the first side of the mounting plate and the first side of the face plate, while the other one of the pair of magazine side guides is located adjacent to the second side of the mounting plate and the second side of the face plate. Each of the magazine side guides comprises a plurality of guide attachment points.

In one embodiment, the present invention further comprises an overtravel stop mechanism. The overtravel stop mechanism comprises a pair of accordion-like members. Each of the accordion-like members comprises a plurality of complementary attachment points. The plurality of mounting plate attachment points of the mounting plate, the plurality of face plate attachment points of the face plate, and the plurality of guide attachment points of the pair of magazine side guides are attachable to the plurality of complementary attachment points. The overtravel stop mechanism allows for the components of the present invention to move under the restriction of the web while being limited to the length of the overtravel stop mechanism.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the present invention. That is, the dimensions of the components of the present invention, independently and in relation to each other can be different. It should be noted that the drawings are schematic and not necessarily drawn to scale. Some drawings are enlarged or reduced to improve drawing legibility.

DETAIL DESCRIPTIONS OF THE INVENTION

Figure 1:
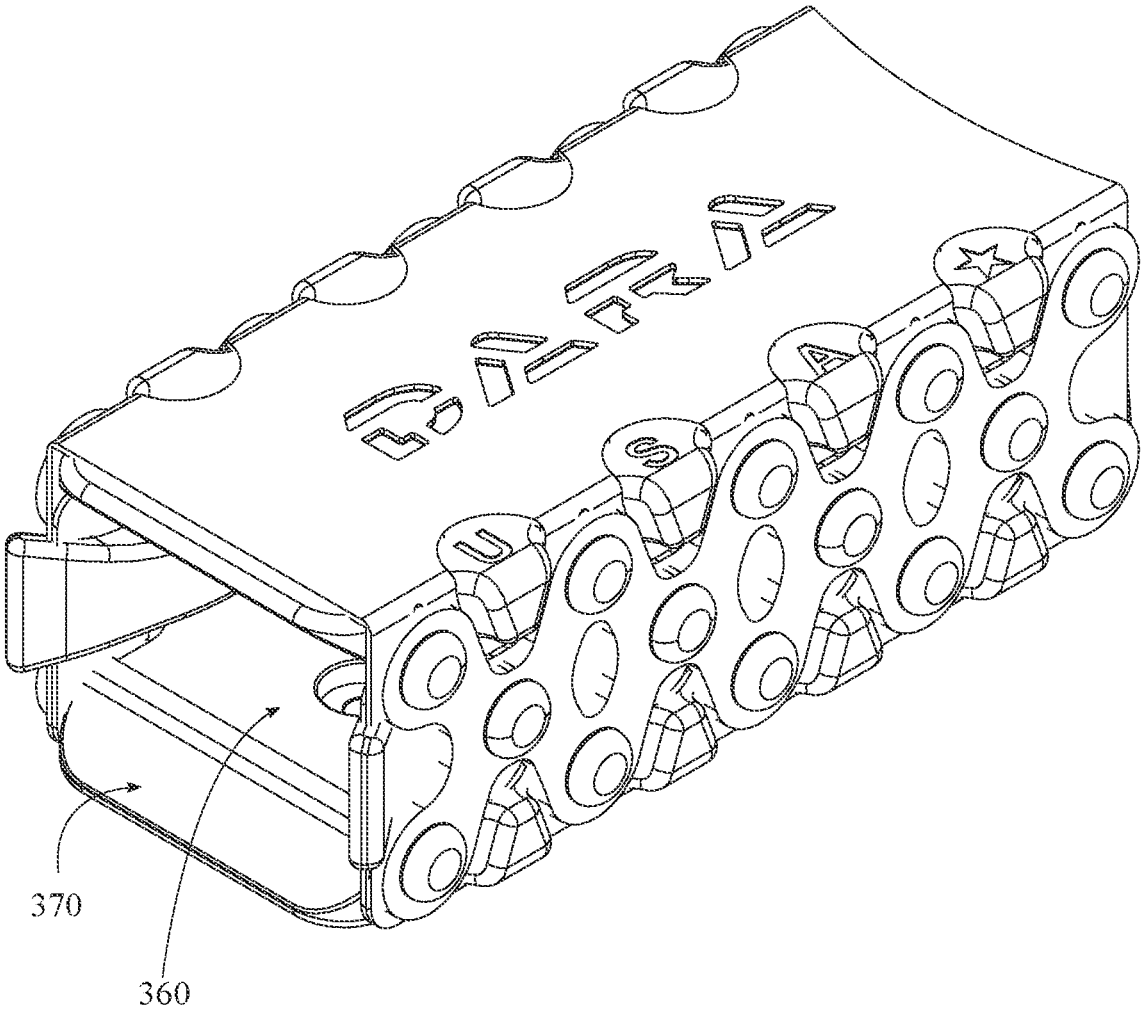
FIG. 1 depicts a perspective view of the present invention.
Figure 2:
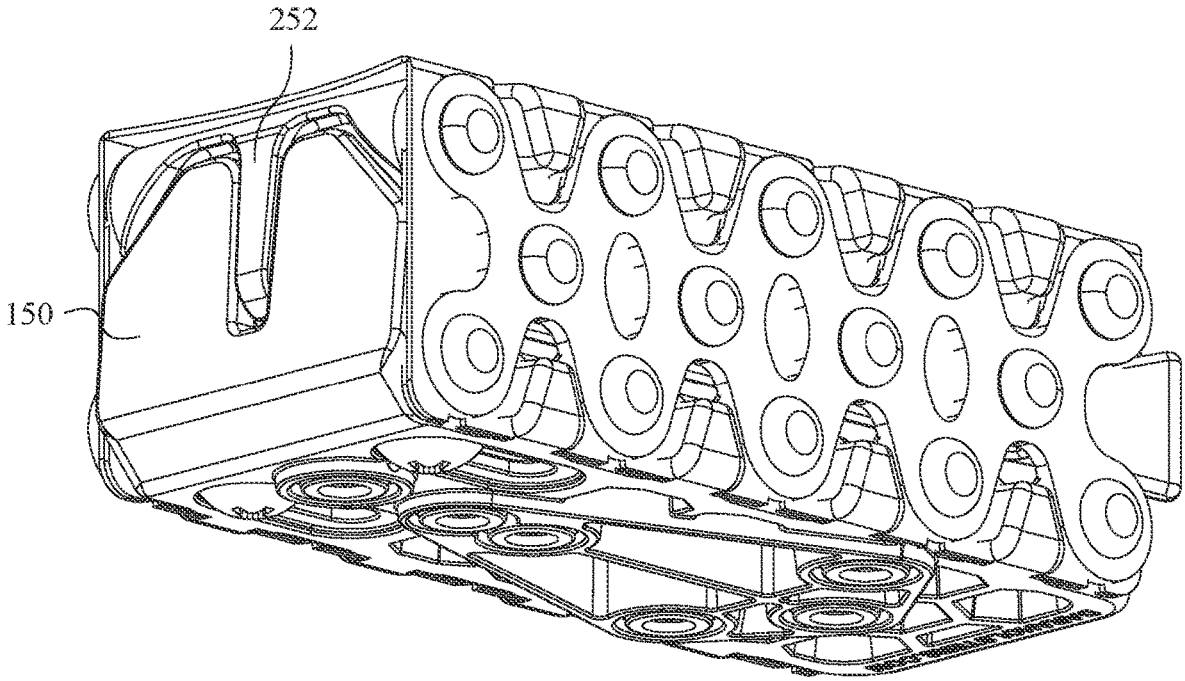
FIG. 2 depicts another perspective view of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and is made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. When not explicitly defined herein, to the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "proximate" refers to positions that are situated close/near in relationship to a structure. As used in the following description, the term "distal" refers to positions that are situated away from positions.

The present disclosure includes many aspects and features. Moreover, while many aspects and features relate to, and are described in the context of automatic retention firearm magazine carriers, embodiments of the present disclosure are not limited to use only in this context.

The present invention is an automatic retention firearm magazine carrier that can conform to a firearm magazine with varying shapes and sizes. The present invention intends to disperse expanding force to multiple points to ensure the present invention will still operate if one point fails or is not connected properly.

Referring now to the figures of the present disclosure. FIGS. 1-4 illustrate the components of the present invention. The automatic retention firearm magazine of the present invention comprises a mounting plate 100, a face plate 200, and a web 400.

Preferably, the automatic retention firearm magazine of the present invention further comprises a pair of magazine side guides 300, a depth adjustment plate 500, and an overtravel stop mechanism 600.

In reference to FIGS. 1-7, the mounting plate 100 and the face plate 200 arranged opposite to each other. The mounting plate 100 may be made of a plastic material with a rectangular shape. However, it should be noted that the mounting plate 100 can be of any shape, size, material, features, type or kind, orientation, location, quantity, components, and arrangements of components that would allow the present invention to fulfill the objectives and intents of the present invention. The mounting plate 100 comprises a first end 102, a second end 104, a first side 106, and a second side 108. Each of the first side 106 and second side 108 of the mounting plate 100 comprises a plurality of mounting plate attachment points 140. In a preferred embodiment, the plurality of mounting plate attachment points 140 of the mounting plate 100 is circular protrusions. Although five mounting plate attachment points are shown on each side of the mounting plate 100 in the illustrated embodiment, a different number of mounting plate attachment points is also contemplated. Moreover, the mounting plate 100 further comprises an outside surface 110 and an opposite interior surface 112. In one embodiment, the mounting plate 100 further comprises a plurality of mounting holes 130. The plurality of mounting holes 130 is positioned on the outside surface 110 of the mounting plate 100 with a circular shape with threaded inner walls. The plurality of mounting holes 130 is designed to allow for the present invention to be secured to a belt attachment or other fastening surface. Preferably, the first end 102 of the mounting plate 100 comprises an inclined surface relative to the interior surface 112 of the mounting plate 100. In one embedment, the mounting plate 100 further comprises an end plate 150 extending perpendicularly from the second end 104 of the mounting plate 100. Preferably, the end plate 150 of the mounting plate 100 is provided with a slit 152.

Figure 10:
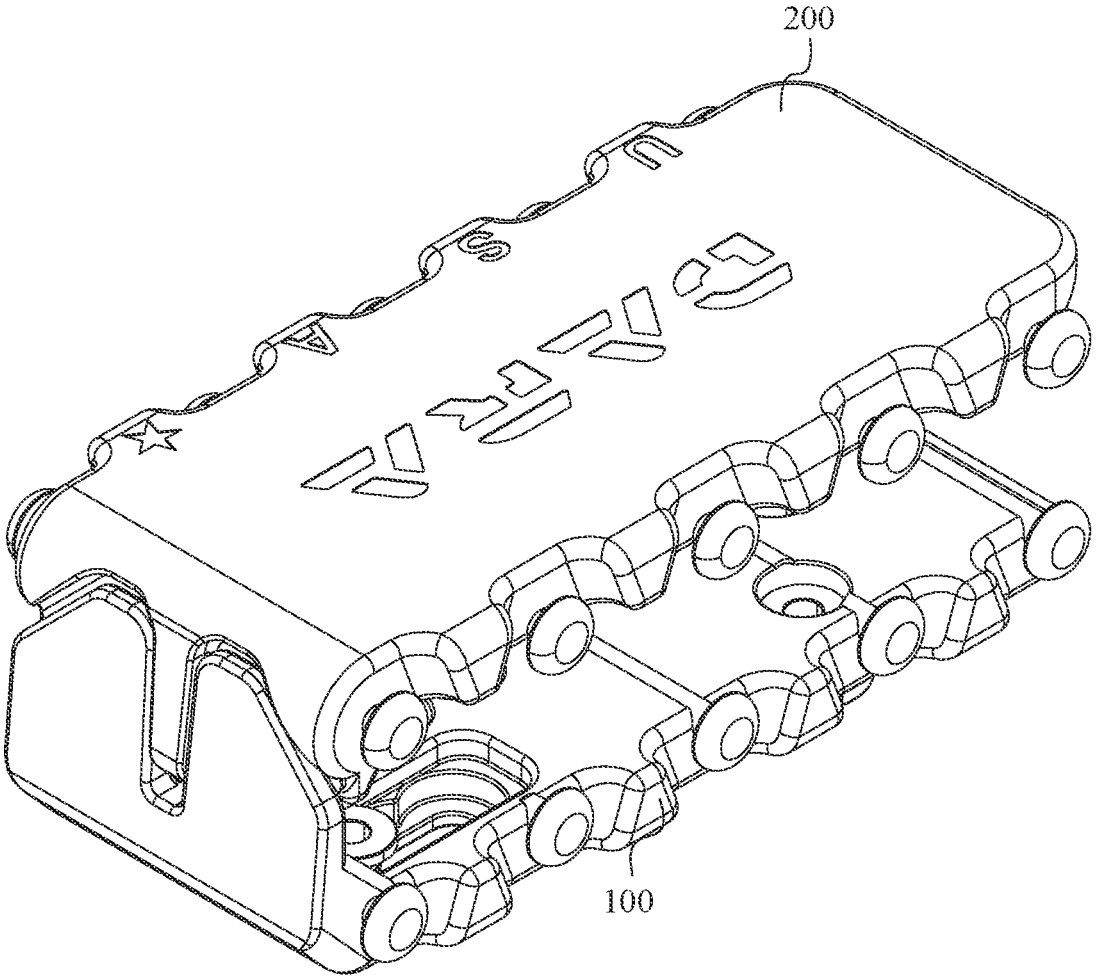
FIG. 10 depicts a perspective view of the present invention, wherein the mounting plate and the face plate are attached together.

In reference to FIGS. 1-4 and 8-9, the face plate 200 may also be made of a plastic material with a rectangular shape. However, it should be noted that the face plate 200 can be of any shape, size, material, features, type or kind, orientation, location, quantity, components, and arrangements of components that would allow the present invention to fulfill the objectives and intents of the present invention. The face plate 200 comprises a first end 202, a second end 204, a first side 206, and a second side 208. Each of the first side 206 and second side 208 of the face plate 200 comprises a plurality of face plate attachment points 240. In a preferred embodiment, the plurality of face plate attachment points 240 of face plate 200 is circular protrusions. Although five face plate attachment points are shown on each side of the face plate 200 in the illustrated embodiment, a different number of face plate attachment points is also contemplated. The plurality of mounting plate attachment points 140 of the mounting plate 100 and the plurality of face plate attachment points 240 of the face plate 200 provide a location for the web 400 to hold the mounting plate 100 and face plate 200 in position. Moreover, the face plate 200 further comprises an outside surface 210 and an opposite interior surface 212. In one embodiment, the interior surface 212 of the face plate 200 comprises a plurality of honeycomb-shaped recesses 214 to enhance structural integrity and reduce the overall weight. Preferably, the first end 202 of the face plate 200 comprises an inclined surface relative to the interior surface 212 of the face plate 200. In one embodiment, the face plate 200 further comprises an end plate 250 extending perpendicularly from the second end 204 of the face plate 200. Preferably, the end plate 250 of the face plate 200 is provided with a ridge 252. The ridge 252 is adapted to insert into the slit 152 to properly position the mounting plate 100 and the face plate 200, as shown in FIG. 10.

Figure 3:
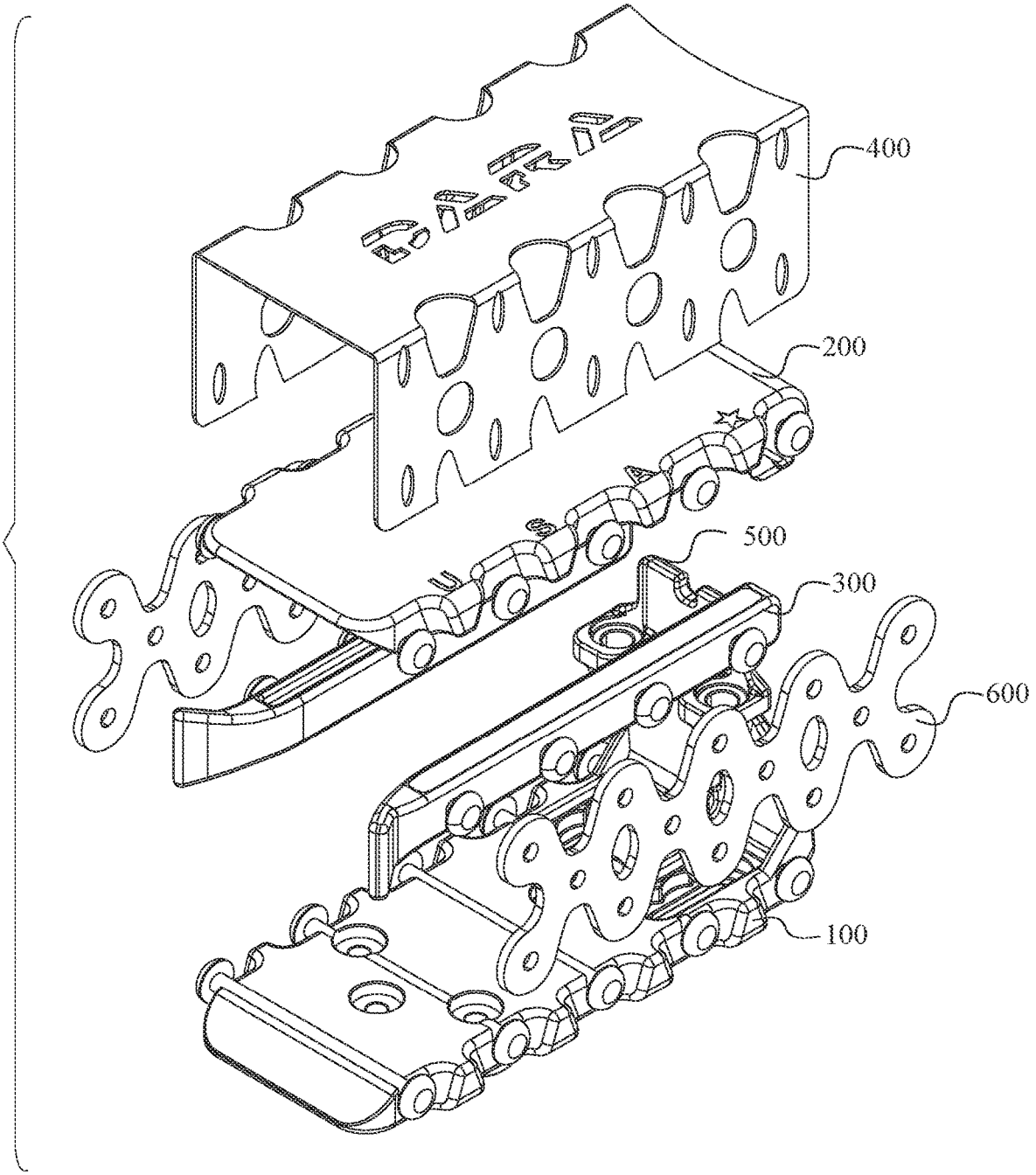
FIG. 3 depicts an exploded perspective view of the present invention.
Figure 4:
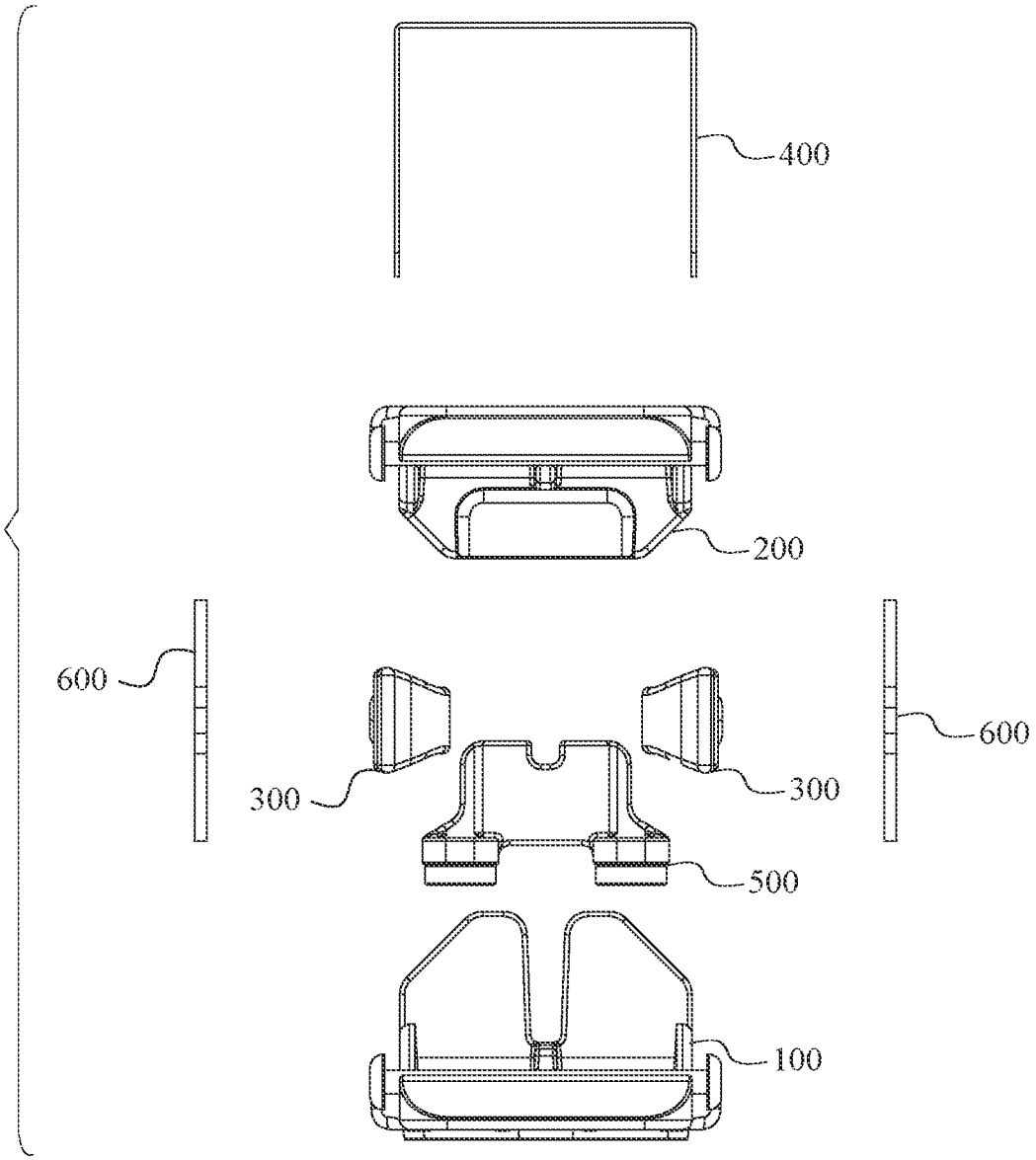
FIG. 4 depicts another exploded front view of the present invention.
Figure 5:
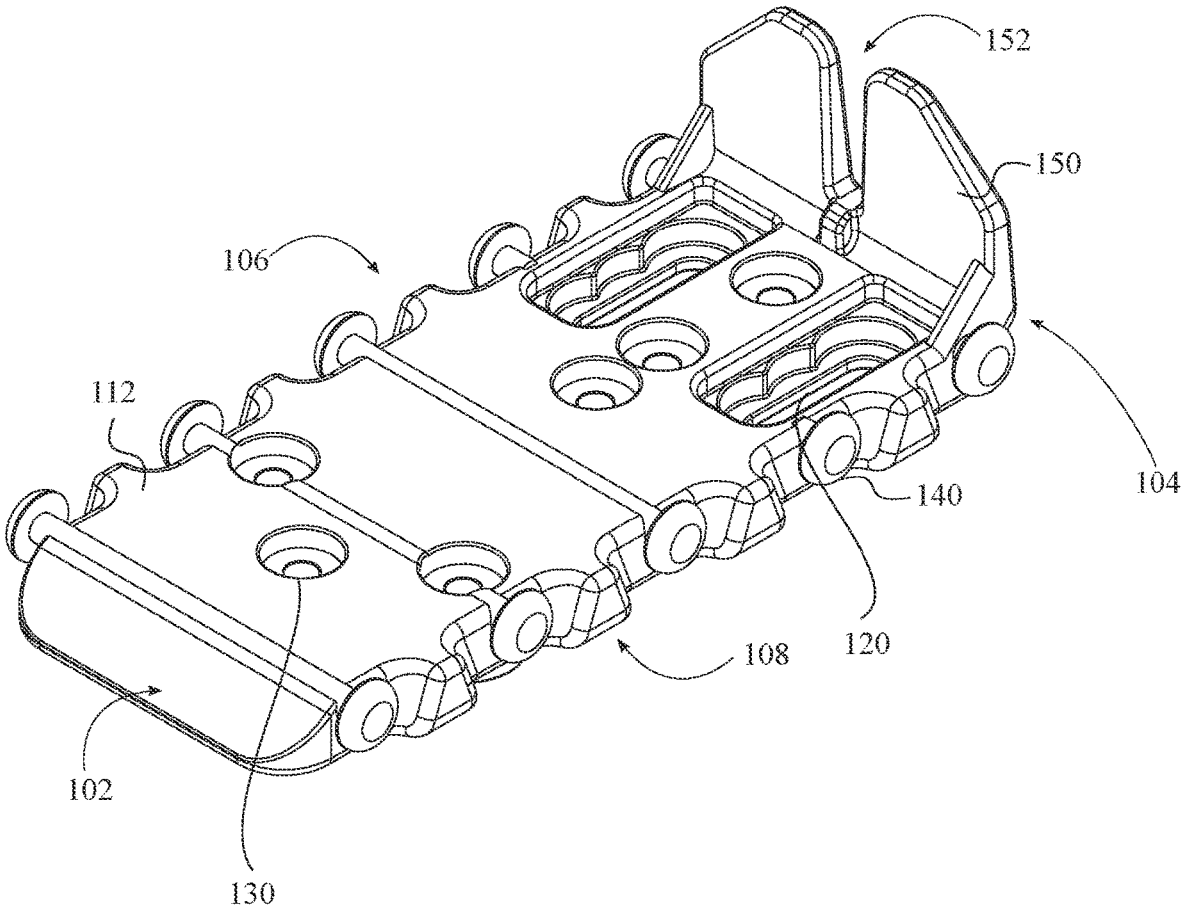
FIG. 5 depicts a perspective view of the mounting plate of the present invention.
Figure 6:
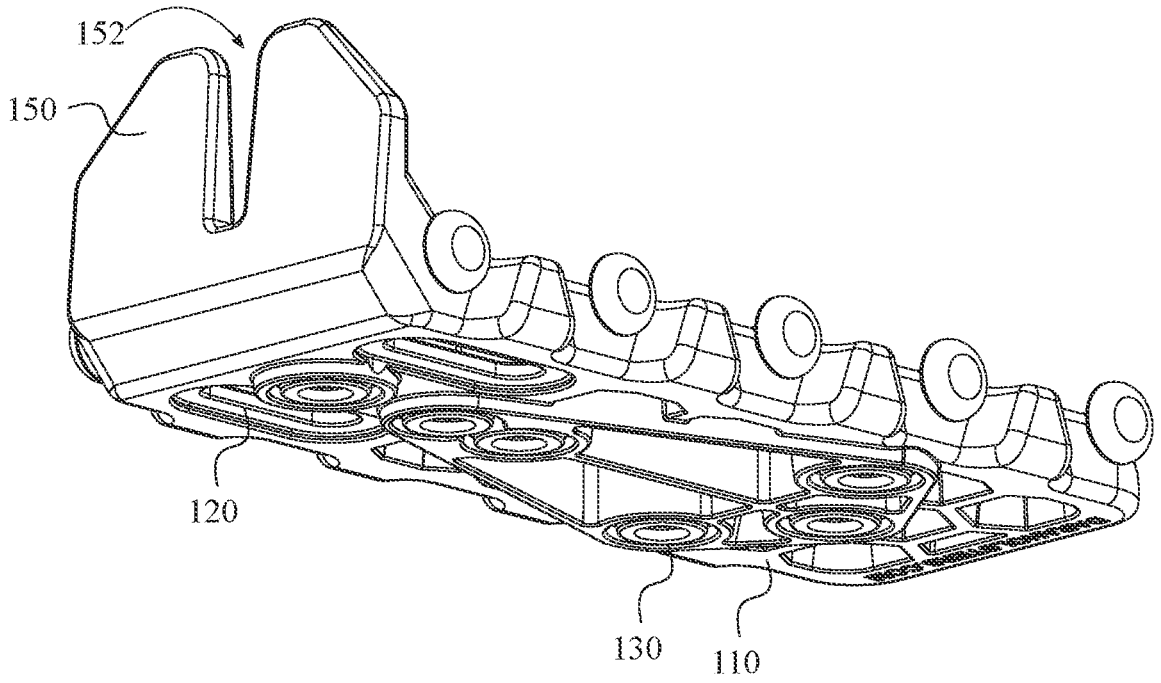
FIG. 6 depicts another perspective view of the mounting plate of the present invention.
Figure 7:
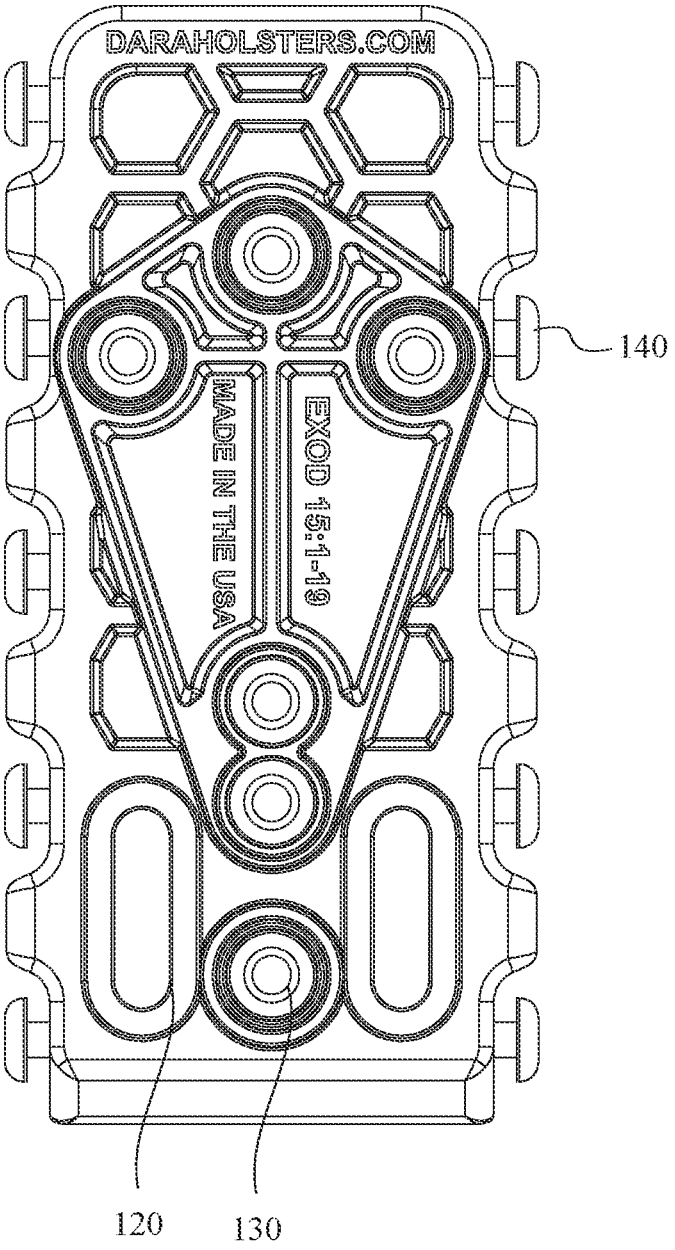
FIG. 7 depicts a bottom view of the mounting plate of the present invention.
Figure 8:
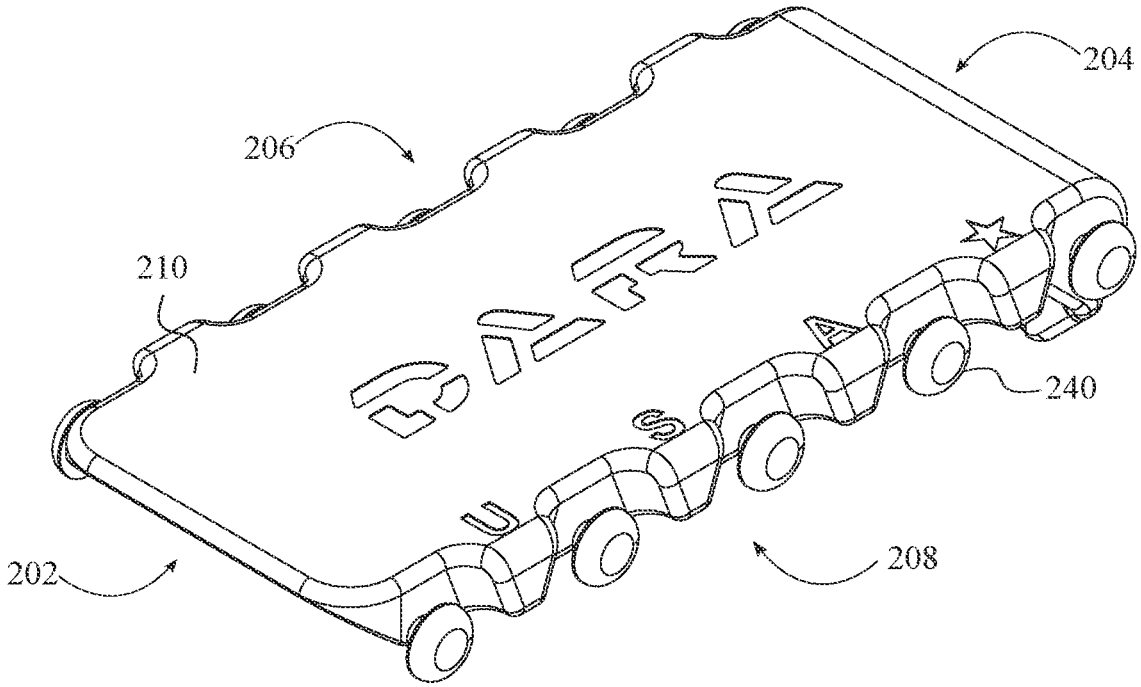
FIG. 8 depicts a perspective view of the face plate of the present invention.
Figure 9:
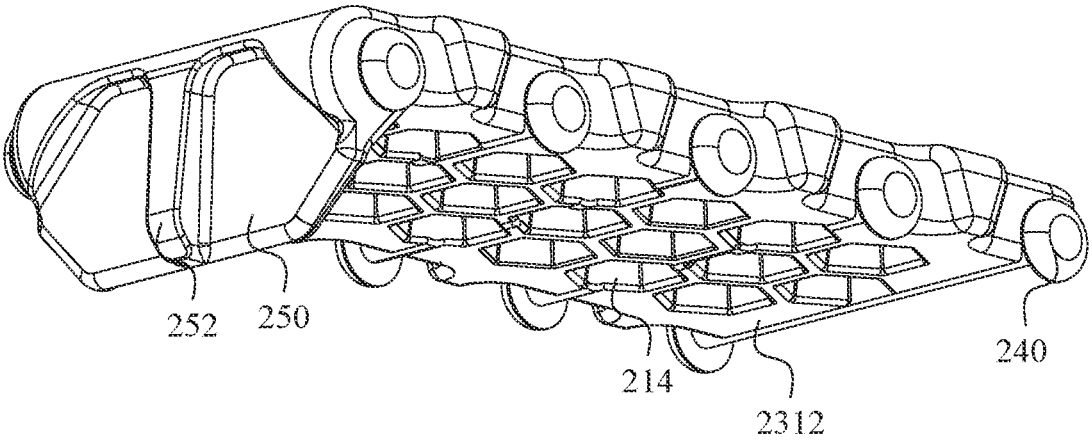
FIG. 9 depicts another perspective view of the face plate of the present invention.
Figure 11:
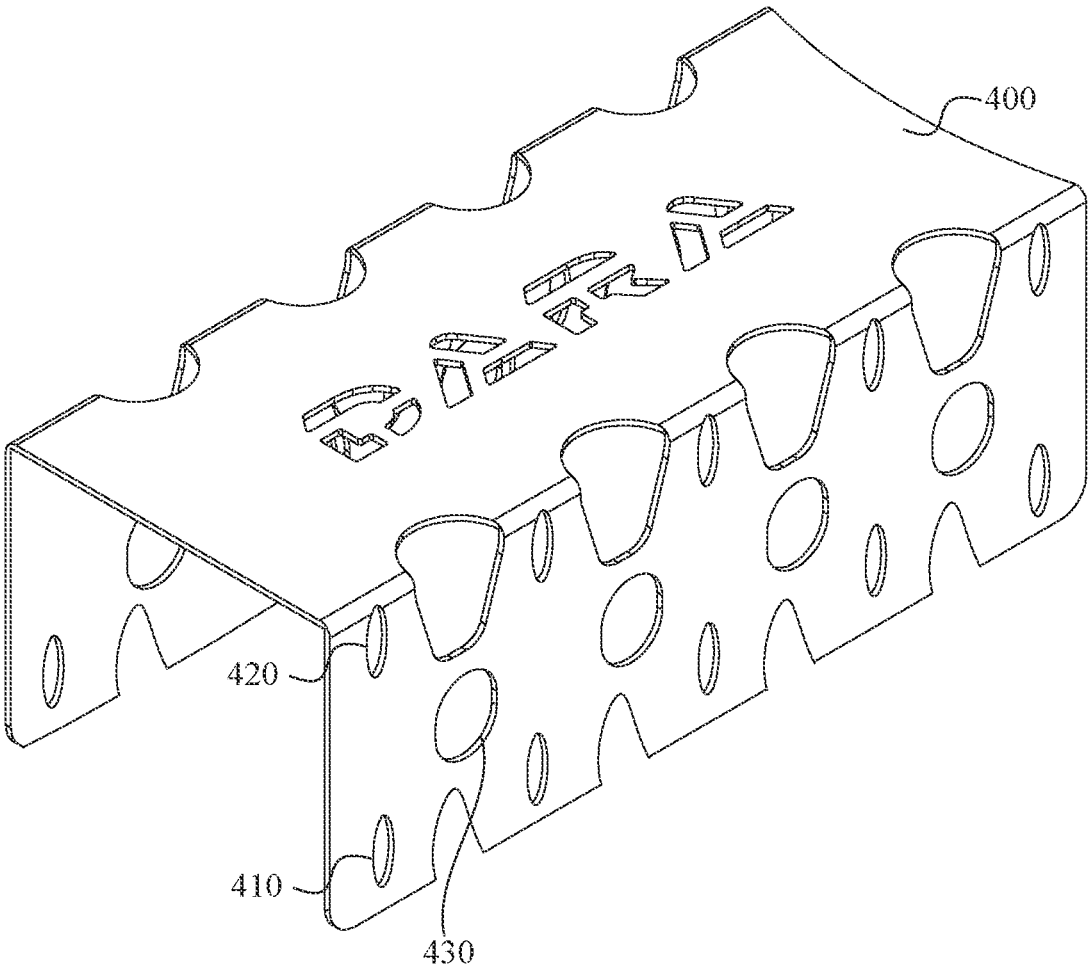
FIG. 11 depicts a perspective view of the web of the present invention.

In reference to FIGS. 3-4 and 11, the web 400 is configured to connect the mounting plate 100, face plate 200, and/or pair of magazine side guides 300 of the present invention together. It should be noted that the web 400 can be of any shape, size, material, features, type or kind, orientation, location, quantity, components, and arrangements of components that would allow the present invention to fulfill the objectives and intents of the present invention. Although merely one integrated web is illustrated in the embodiment, it is contemplated that more than one web may be used. For example, two separate webs may be attached to either side of the mounting plate 100 and face plate 200. In another example, more than one layer of webs may be used. In one embodiment, the web 400 comprises a plurality of mounting plate complementary attachment points 410 corresponding to the plurality of mounting plate attachment points 140 such that the plurality of mounting plate attachment points 140 is attachable to the plurality of mounting plate complementary attachment points 410 of the web 400. Moreover, the web 400 further comprises a plurality of face plate complementary attachment points 420 corresponding to the plurality of face plate attachment points 240 such that the plurality of face plate attachment points 240 is attachable to the plurality of mounting plate complementary attachment points 410 of the web 400. Preferably, the plurality of mounting plate complementary attachment points 410 and plurality of face plate complementary attachment points 420 are holes into which the plurality of mounting plate attachment points 140 and plurality of face plate attachment points 240 can be inserted. The web 400 is resilient to provide a retention force to keep the mounting plate 100 and the face plate 200 in position. In one example, the web 400 is a polyurethane rubber retention web that expands and contracts in accordance with the size and profile of the inserted firearm magazine.

Figure 12:
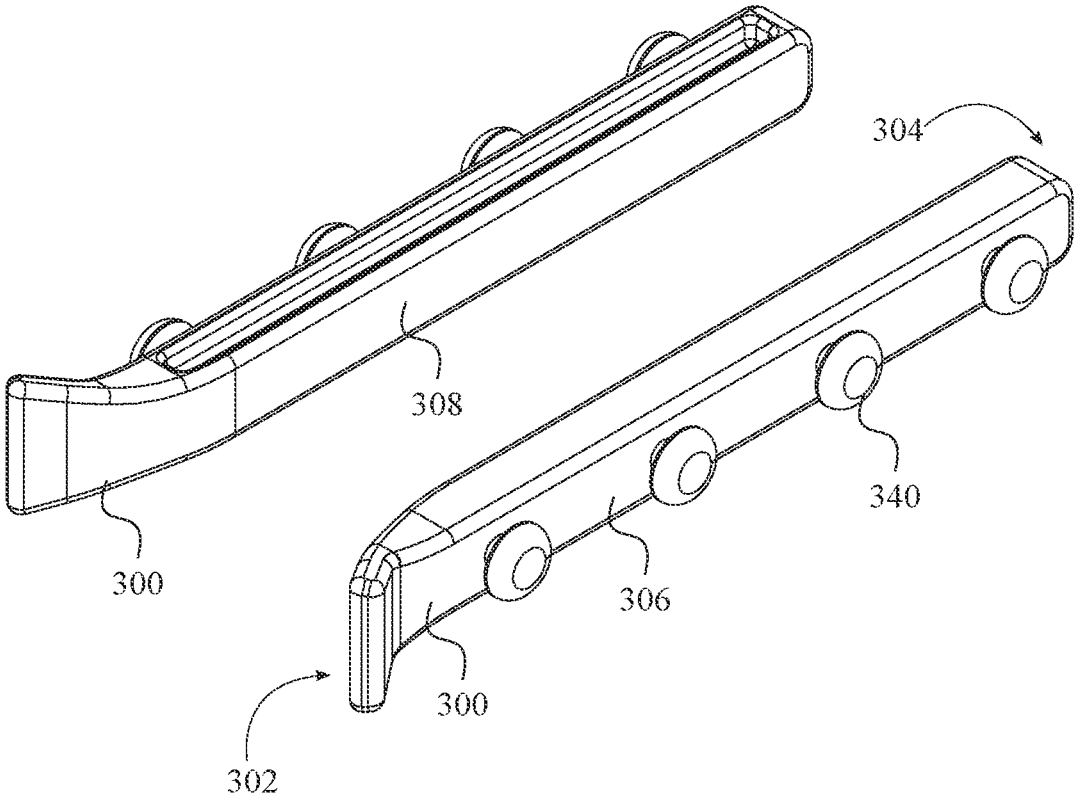
FIG. 12 depicts a perspective view of the magazine side guides of the present invention.
Figure 13:
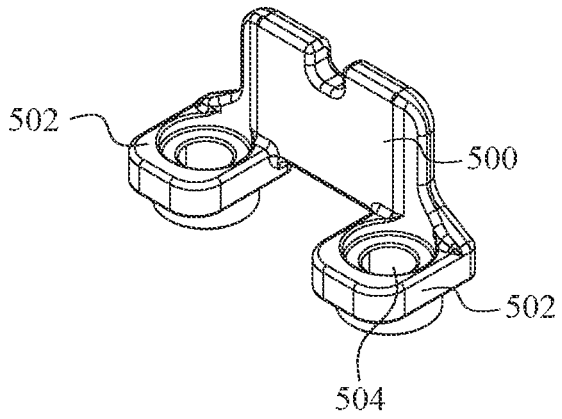
FIG. 13 depicts a perspective view of the depth adjustment plate of the present invention.
Figure 14:
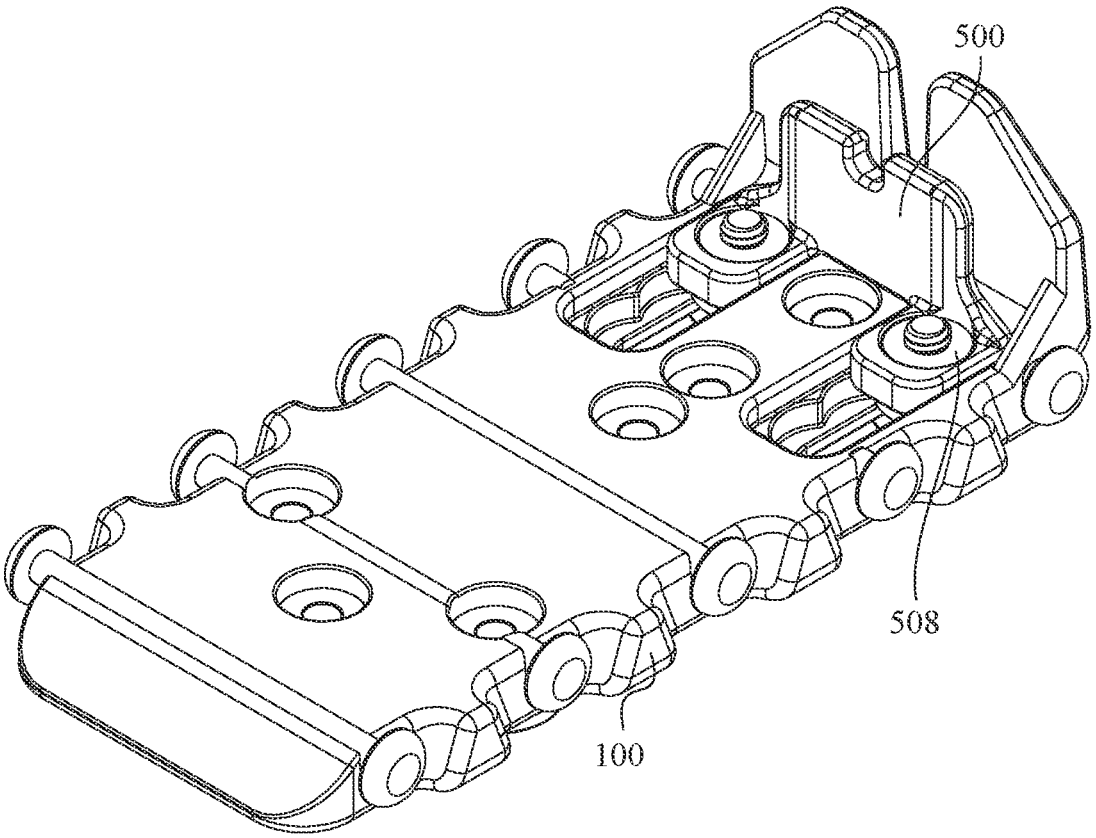
FIG. 14 depicts a perspective view of the present invention, wherein the depth adjustment plate is installed on the mounting plate.
Figure 15:
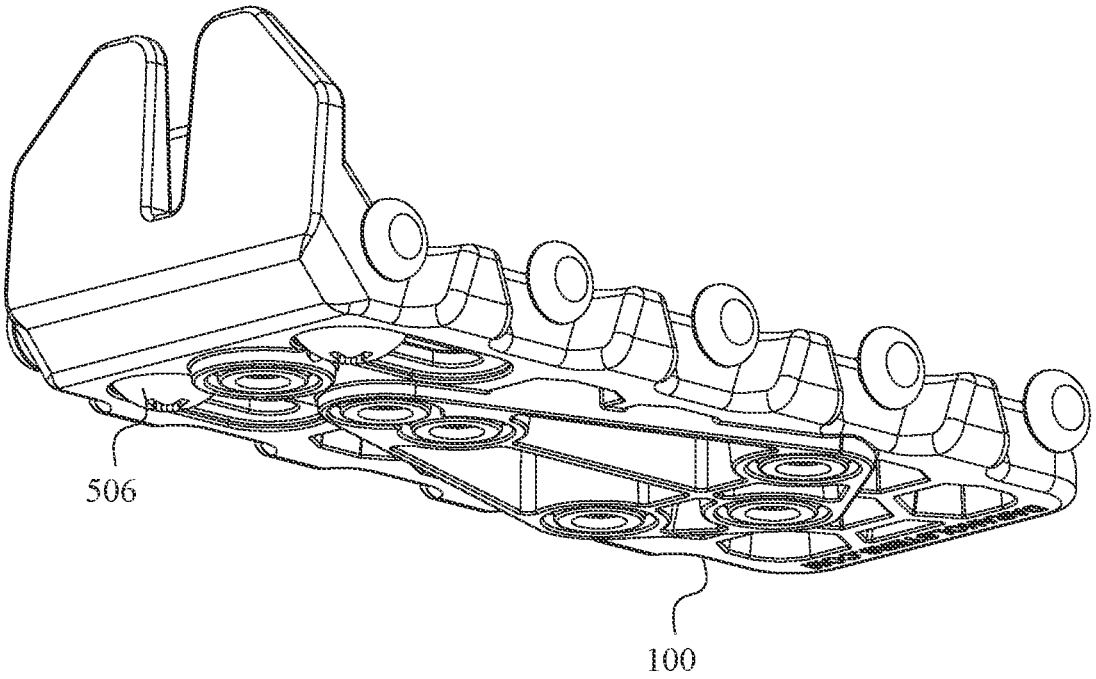
FIG. 15 depicts another perspective view of the present invention, wherein the depth adjustment plate is installed on the mounting plate.

In reference to FIGS. 3-4 and 12, the pair of magazine side guides 300 is located between the mounting plate 100 and the face plate 200, with one of magazine side guides 300 being adjacent to the first side 106 of the mounting plate 100 and the first side 206 of the face plate 200, and the other one of magazine side guides 300 being adjacent to the second side 108 of the mounting plate 100 and the second side 208 of the face plate 200. It should be noted that the web 400 can be of any shape, size, material, features, type or kind, orientation, location, quantity, components, and arrangements of components that would allow the present invention to fulfill the objectives and intents of the present invention. Each of magazine side guides 300 comprises a first end second end 304, a 304, an outside surface 306, and an interior surface 308. The outside surface 306 comprises a plurality of guide attachment points 340, and the web 400 further comprises a plurality of guide complementary attachment points 430 corresponding to the plurality of guide attachment points 340 such that the plurality of guide attachment points 340 is attachable to the plurality of mounting plate complementary attachment points 410 of the web 400. The plurality of guide attachment points 340 provides a location for web 400 to fasten to the pair of magazine side guides 300. Although four guide attachment points are shown on each of magazine side guides 300 in the illustrated embodiment, a different number of guide attachment points is also contemplated. Preferably, the plurality of guide attachment points 340 of the pair of magazine side guides 300 is circular protrusions, while the plurality of guide complementary attachment points 430 are holes. In this way, the mounting plate 100, the face plate 200, and the pair of magazine side guides 300 form an expandable shell by means of the web 400 described above. Specifically, the interior surface 112 of the mounting plate 100, the interior surface 212 of the face plate 200, the interior surfaces 308 of the pair of magazine side guides 300 form an interior space 360 for the insertion of the firearm magazine. In a preferred embodiment, the first end 302 of each of the magazine side guides 300 comprises an inclined surface relative to the interior surface 308 of a respective magazine side guide 300. In this configuration, the first end second end 304 of the pair of magazine side guides 300, together with inclined surfaces located at the first end 102 of the mounting plate 100 and the first end 202 of the face plate 200, form a flared opening 370 through which the firearm magazine is inserted.

In reference to FIGS. 3-4 and 13-15, the depth adjustment plate 500 is attached to the mounting plate 100 and positioned inside the interior space 360. The depth adjustment plate 500 is L-shaped with a pair of depth adjustment plate mounting tabs 502. The mounting plate 100 further comprises a pair of elongated holes 120 adjacent to the second end 104 of the mounting plate 100. Each of the depth adjustment plate mounting tabs 502 comprises a depth adjustment plate mounting hole 504 and is provided with a screw 506 and a 508 such that a position of the depth adjustment plate 500 is adjustable along the pair of elongated holes 120. The screws traverse through the pair of elongated holes 120 as shown in FIG. 4 and secure the depth adjustment plate to a desired depth along the mounting plate by means of the nuts. This design allows for the present invention to have a hard stop for a firearm magazine being inserted at varying lengths.

Figure 16:
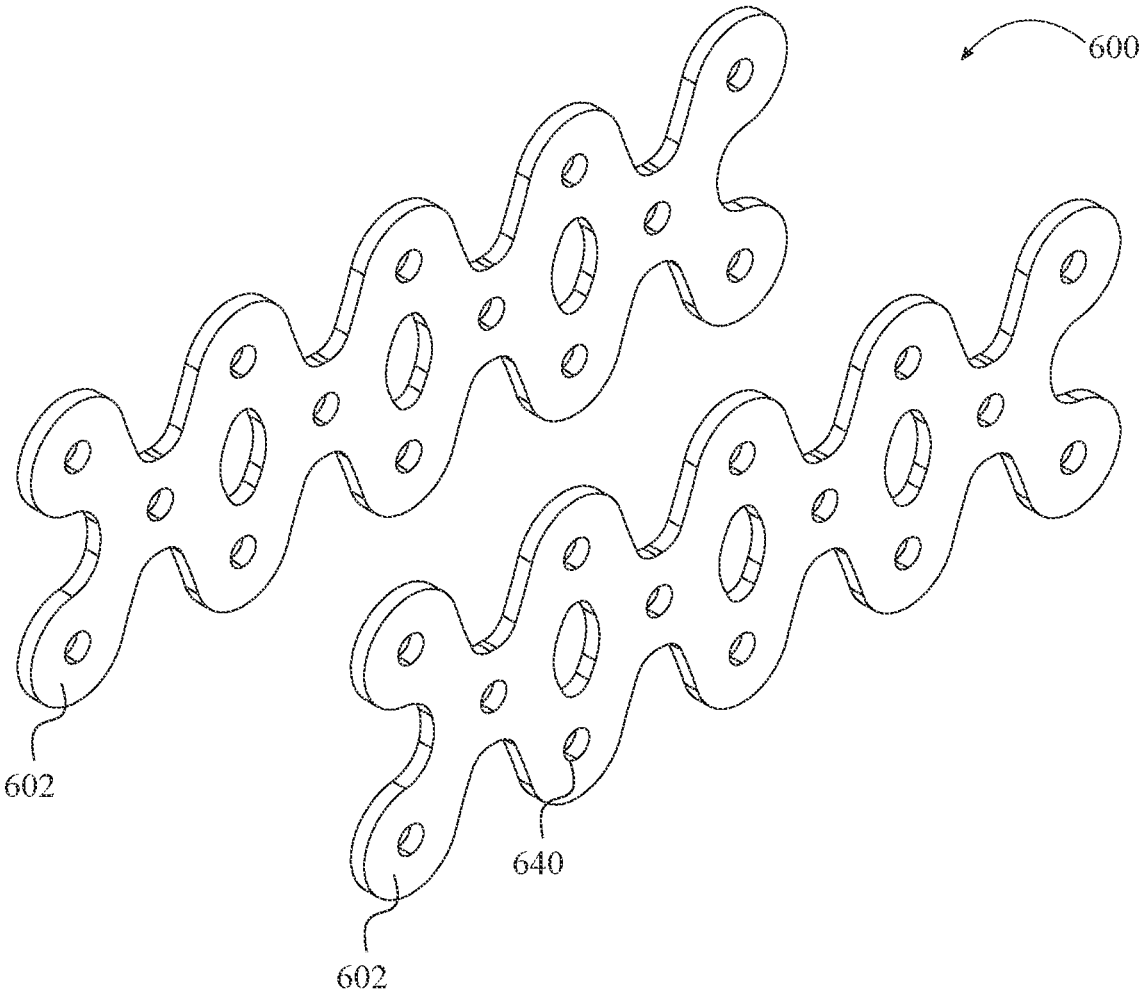
FIG. 16 depicts a perspective view of the overtravel stop mechanism of the present invention.

In reference to FIGS. 3-4 and 16, the overtravel stop mechanism 600 is configured to prevent the present invention from expanding more than desired while reducing Infrared reflectivity to protect the user from night vision visibility. Preferably, the overtravel stop mechanism 600 is made from nylon. In the illustrated embodiment, the overtravel stop mechanism 600 comprises a pair of accordion-like members 602 that allows for the components of the present invention to move under the restriction of the web while being limited to the length of the overtravel stop mechanism 600. Each of the accordion-like members 602 comprises a plurality of complementary attachment points 640. The plurality of mounting plate attachment points 140 of the mounting plate 100, the plurality of face plate attachment points 240 of the face plate 200, and the plurality of guide attachment points 340 of the pair of magazine side guides 300 is attachable to the plurality of complementary attachment points 640. Preferably, the plurality of complementary attachment points 640 are holes through which the attachment points of the mounting plate 100, face plate 200, and the pair of magazine side guides 300 may be inserted. In this way, the overtravel stop mechanism 600 attaches at all of the attachment points of the mounting plate 100, the face plate 200, and the pair of magazine side guides 300.

Although the disclosure has been explained in relation to its preferred embodiment, it is to be understood that many other possible modifications and variations can be made without departing from the spirit and scope of the disclosure.

What is claimed is:

1. An automatic retention firearm magazine carrier, comprising:

a mounting plate;

a face plate;

a web;

the mounting plate and the face plate being arranged opposite to each other;

the mounting plate comprising a first end, a second end, a first side, and a second side;

the face plate comprising a first end, a second end, a first side, and a second side;

each of the first side and the second side of the mounting plate comprising a plurality of mounting plate attachment points;

each of the first side and the second side of the face plate comprising a plurality of face plate attachment points;

the web comprising a plurality of mounting plate complementary attachment points corresponding to the plurality of mounting plate attachment points such that the plurality of mounting plate attachment points is attachable to the plurality of mounting plate complementary attachment points of the web;

the web further comprising a plurality of face plate complementary attachment points corresponding to the plurality of face plate attachment points such that the plurality of face plate attachment points is attachable to the plurality of mounting plate complementary attachment points of the web, wherein the plurality of mounting plate attachment points of the mounting plate and the plurality of face plate attachment points of the face plate are circular protrusions, while the plurality of mounting plate complementary attachment points and the plurality of face plate complementary attachment points are holes; and the web being resilient to provide a retention force to keep the mounting plate and face plate in position.

2. The automatic retention firearm magazine carrier as claimed in claim 1, further comprising:

a pair of magazine side guides located between the mounting plate and the face plate;

one of the magazine side guides being adjacent to the first side of the mounting plate and the first side of the face plate, while the other one of the magazine side guides being adjacent to the second side of the mounting plate and the second side of the face plate; and each of the magazine side guides comprising a first end, a second end, an outside surface, and an interior surface.

3. The automatic retention firearm magazine carrier as claimed in claim 2, wherein the outside surface comprises a plurality of guide attachment points, and the web further comprises a plurality of guide complementary attachment points corresponding to the plurality of guide attachment points such that the plurality of guide attachment points is attachable to the plurality of mounting plate complementary attachment points of the web.

4. The automatic retention firearm magazine carrier as claimed in claim 3, wherein the mounting plate further comprises an outside surface and an opposite interior surface, and the face plate further comprises an outside surface and an opposite interior surface, the interior surface of the mounting plate, the interior surface of the face plate, the interior surface of the pair of magazine side guides forming an interior space for the insertion of a firearm magazine.

5. The automatic retention firearm magazine carrier as claimed in claim 4, wherein the first end of each of the magazine side guides comprises an inclined surface relative to the interior surface of a respective magazine side guide.

6. The automatic retention firearm magazine carrier as claimed in claim 4, wherein the first end of the mounting plate comprises an inclined surface relative to the interior surface of the mounting plate, and the first end of the face plate comprises an inclined surface relative to the interior surface of the face plate, to form a flared opening through which the firearm magazine is inserted.

7. The automatic retention firearm magazine carrier as claimed in claim 3, wherein the plurality of mounting plate attachment points of the mounting plate, the plurality of face plate attachment points of the face plate, and the plurality of guide attachment points of the pair of magazine side guides are circular protrusions, while the plurality of mounting plate complementary attachment points, the plurality of face plate complementary attachment points, and the plurality of guide complementary attachment points are holes.

8. The automatic retention firearm magazine carrier as claimed in claim 1, wherein each of the first side and second side of the mounting plate comprises five mounting plate attachment points.

9. The automatic retention firearm magazine carrier as claimed in claim 1, wherein each of the first side and second side of the face plate comprises five face plate attachment points.

10. The automatic retention firearm magazine carrier as claimed in claim 3, wherein the outside surface comprises four guide attachment points.

11. The automatic retention firearm magazine carrier as claimed in claim 1, wherein the interior surface of the face plate comprises a plurality of honeycomb-shaped recesses.

12. The automatic retention firearm magazine carrier as claimed in claim 1, wherein the mounting plate further comprises a plurality of mounting holes.

13. The automatic retention firearm magazine carrier as claimed in claim 1, wherein the mounting plate further comprises an end plate extending perpendicularly from the second end of the mounting plate.

14. The automatic retention firearm magazine carrier as claimed in claim 13, wherein the face plate further comprises an end plate extending perpendicularly from the second end of the face plate.

15. The automatic retention firearm magazine carrier as claimed in claim 14, wherein the end plate of the mounting plate is provided with a slit, and the end plate of the face plate is provided with a ridge, the ridge being adapted to insert into the slit to properly position the mounting plate and the face plate.

16. The automatic retention firearm magazine carrier as claimed in claim 1, further comprising a depth adjustment plate attached to the mounting plate.

17. An automatic retention firearm magazine carrier, comprising:

a mounting plate;

a face plate;

a web;

a depth adjustment plate attached to the mounting plate;

the mounting plate and the face plate being arranged opposite to each other;

the mounting plate comprising a first end, a second end, a first side, and a second side;

the face plate comprising a first end, a second end, a first side, and a second side;

each of the first side and the second side of the mounting plate comprising a plurality of mounting plate attachment points;

each of the first side and the second side of the face plate comprising a plurality of face plate attachment points;

the web comprising a plurality of mounting plate complementary attachment points corresponding to the plurality of mounting plate attachment points such that the plurality of mounting plate attachment points is attachable to the plurality of mounting plate complementary attachment points of the web;

the web further comprising a plurality of face plate complementary attachment points corresponding to the plurality of face plate attachment points such that the plurality of face plate attachment points is attachable to the plurality of mounting plate complementary attachment points of the web;

the web being resilient to provide a retention force to keep the mounting plate and face plate in position; and the depth adjustment plate comprising a pair of depth adjustment plate mounting tabs, and the mounting plate further comprising a pair of elongated holes adjacent to the second end of the mounting plate, each of the depth adjustment plate mounting tabs comprising a depth adjustment plate mounting hole and being provided with a nut and a screw such that a position of the depth adjustment plate is adjustable along the pair of elongated holes.

18. An automatic retention firearm magazine carrier, comprising:

a mounting plate;

a face plate;

a web;

an overtravel stop mechanism;

the mounting plate and the face plate being arranged opposite to each other;

the mounting plate comprising a first end, a second end, a first side, and a second side;

the face plate comprising a first end, a second end, a first side, and a second side;

each of the first side and the second side of the mounting plate comprising a plurality of mounting plate attachment points;

each of the first side and the second side of the face plate comprising a plurality of face plate attachment points;

the web comprising a plurality of mounting plate complementary attachment points corresponding to the plurality of mounting plate attachment points such that the plurality of mounting plate attachment points is attachable to the plurality of mounting plate complementary attachment points of the web;

the web further comprising a plurality of face plate complementary attachment points corresponding to the plurality of face plate attachment points such that the plurality of face plate attachment points is attachable to the plurality of mounting plate complementary attachment points of the web;

the web being resilient to provide a retention force to keep the mounting plate and face plate in position;

the overtravel stop mechanism comprising a pair of accordion-like members;

each of the accordion-like members comprising a plurality of complementary attachment points; and the plurality of mounting plate attachment points of the mounting plate, the plurality of face plate attachment points of the face plate, and the plurality of guide attachment points of the pair of magazine side guides being attachable to the plurality of complementary attachment points.

19. The automatic retention firearm magazine carrier as claimed in claim 18, wherein the plurality of mounting plate attachment points of the mounting plate, the plurality of face plate attachment points of the face plate, and the plurality of guide attachment points of the pair of magazine side guides are circular protrusions, while the plurality of complementary attachment points are holes.

* * * * *